United States Patent [19]

Brown-Zimmermann

[11] Patent Number: 4,471,502

[45] Date of Patent: Sep. 18, 1984

[54] FAUCET SPOUT ACCESSORY

[76] Inventor: Karen M. Brown-Zimmermann, 2301 W. 67th St., Indianapolis, Ind. 46260

[21] Appl. No.: 470,557

[22] Filed: Feb. 28, 1983

[51] Int. Cl.[3] ..... A47B 95/02; A47K 17/00

[52] U.S. Cl. ..... 4/661; 16/116 R; 16/118; 16/DIG. 30; 16/121

[58] Field of Search ..... 4/661; 16/117, 116 R, 16/121 R, DIG. 30, 114, 118

[56] References Cited

U.S. PATENT DOCUMENTS

| | | | |
|---|---|---|---|
| 1,629,449 | 5/1927 | Duffield | 16/117 |
| 2,294,661 | 9/1942 | Hibbard | 16/118 |
| 2,619,672 | 12/1952 | Glaser et al. | 16/116 R |
| 3,302,826 | 2/1967 | Henchert et al. | 16/114 R X |
| 3,808,635 | 5/1974 | Moran et al. | 16/121 |
| 4,197,611 | 4/1980 | Bell et al. | 16/116 R |
| 4,223,931 | 9/1980 | Neary | 16/121 X |

FOREIGN PATENT DOCUMENTS

| | | | |
|---|---|---|---|
| 825778 | 12/1951 | Fed. Rep. of Germany | 16/116 R |

*Primary Examiner*—Henry K. Artis

[57] ABSTRACT

An auxiliary handle is attached to a pivotal faucet spout. The handle has a high thermal resistance. When used to pivot the faculet spout, heat from a hot spout will not be transferred to the use's hand.

8 Claims, 4 Drawing Figures

FAUCET SPOUT ACCESSORY

BACKGROUND OF THE INVENTION

1. Field of the Invention

The present invention relates to an accessary for use with a pivotal faucet spout and in particular to such an apparatus which provides an auxiliary handle for moving the spout which handle has high thermal resistance thereby obviating the transfer of heat from a hot spout to a users hand.

2. Description of the Prior Art

Pivotal faucet spouts are a common and useful device for kitchen and laundry room sinks. The pivotal spout permits the faucet to be moved either from one to the other of a plurality of side by side sinks, a common arrangement in most households, or into various positions to faciliate rinsing of pots and pans to provide access to the sink for large objects.

It is also common that when the sink faucet is being used for such purposes as rinsing dishes and the like, the user operates the sink at very high water temperatures to both increase the effectiveness of the rinsing and for sanitation reasons. Unfortunately, faucet spouts are typically fabricated of metal and the use of high water temperatures produces a correspondingly high faucet spout temperature. Frequently these temperatures are well above pain level temperatures (about 105° to 120° ). The result is that the user, when attempting to reposition the faucet spout during use, will burn their hand or fingers or attempt to move the spout with an object such as a pot or pan which frequently results in splashing or water and similar undesirable events.

In its broader aspects, the invention is an auxiliary knob made from a flexible, resilient material such as rubber and which includes a ring portion adapted to slip firmly over the distal end portion of a faucet spout and a protruding knob portion fixedly secured to the ring portion and extending upwardly therefrom when the ring portion is received over the faucet spout. The entire auxiliary knob is preferably manufactured as an integral, molded unit and is made from a material having a low coefficent of conductivity when compared with the coefficent conductivity of metals. The apparatus further preferably includes a connecting portion which is an integral part of the protruding portion which is of smaller cross-section then the distal end or knob portion thereof thereby further reducing the effective temperature of the protruding portions that can be gripped by the finger or hand. The protruding portion can be fabricated to simulate various objects such as mushroom, flowers, and the like and can be provided in a variety of colors for aesthetic purposes.

It is therefore an object of the invention to provide an auxiliary knob which can be affixed to conventional faucet spouts to provide a means for maneuvering the spout when the spout is hot without burning the users hand or fingers.

Another object of the invention is to provide such a device which is simple and inexpensive and can be installed on existing faucet spouts without modification or tools.

Yet another object of the invention is to provide such an apparatus which is aestheticaly pleasing without detracting from its intended function and purpose.

Another object of the invention is to provide such a device which includes a ring portion of resilient material which can be slidably yet firmly engaged with a variety of faucet spouts.

Another object of the invention is to provide such a device which includes a protruding knob portion made of a material having low thermal conductivity and including a reduced cross-section connective portion and an enlarged knob portion to further reduce heat transfer to the enlarged knob portion.

BRIEF DESCRIPTION OF THE DRAWINGS

The above-mentioned and other features and objects of this invention and the manner of attaining them will be best understood by reference to the following description of an embodiment of the invention taken in conjunction with the accompanying drawings wherein.

DESCRIPTION OF A PREFERRED EMBODIMENT

Figure 1:
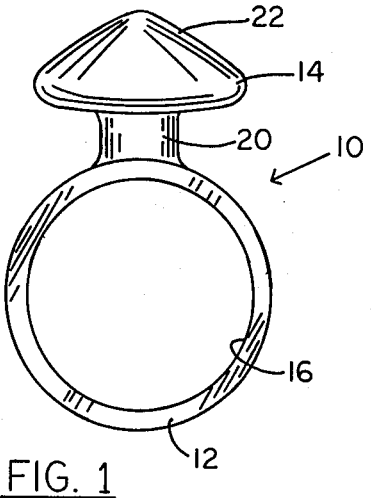
FIG. 1 is a front plan view of an embodiment of the invention.

Referring now to the drawings, there shown in FIGS. 1 through 4 a faucet knob indicated generally at 10 which comprises a ring portion 12 and an upwardly (as viewed in the drawings) extending gripping portion 14.

The ring portion 12 will be of generally rectangular transverse cross-section or at least of cross-section that it has a generally flat internal surface 16. The circumferential dimension of the ring portion 12 may be of any desired length it however being necessary that the circumferential dimension be smaller than the circumferential dimension of the distal portion 18 of a conventional pivoting faucet spout 18. The ring portion 12 is further made of a suitable resilient elastic material such as rubber. Accordingly, the ring portion 12 can be forcibly slid over the end 20 of the faucet spout 18 with the surface 16 thereof further engaging the external surface of the spout portion 18. It is further desirable that the ring portion 12 be fabricated of a material which exhibits a reasonably high friction with the faucet surface so that, when installed, the knob 10 will not slip or slide.

The gripping portion 14 is preferably formed as an integral part of the ring portion 12 and of the same material. The gripping portion 14 includes a connecting portion 20 and an enlarged knob portion 22. Accordingly, the heat transfer from the ring portion 12 through the reduced cross-section portion 20 and to the knob portion 22 is reduced. Additionally, by utilizing materials such as rubber or a variety of resilient and elastic plastics, all of which exhibit relatively high thermal resistance factors, heat transfer to the knob portion 22 is relatively low enabling the knob portion 22 to remain at a substantially lowered temperature than the spout 18. Additionally, by utilizing materials having low thermal transfer coefficients, heat transfer to the skin is reduced whereby even at elevated temperatures, heat transfer to the skin is reduced thereby obviating the possibility of burns and disconfort to the user.

Figure 4:
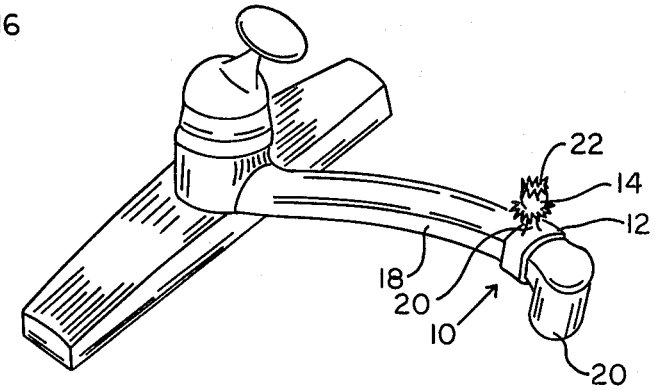
FIG. 4 is a perspective view showing the device of the present invention attached to a conventional pivotable faucet spout.
Figure 2:
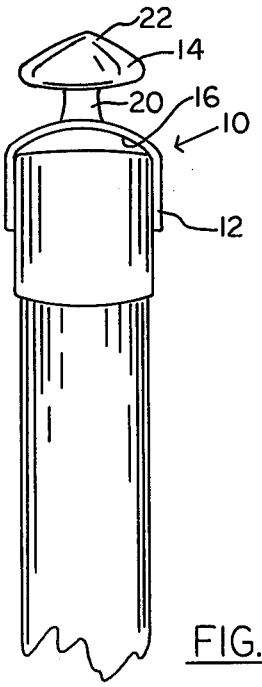
FIG. 2 is a fragmentary front plan view of a conventional pivotal faucet with the device of the present invention attached thereto.
Figure 3:
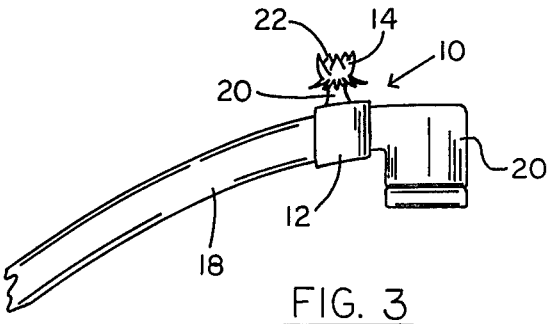
FIG. 3 is a fragmentary side plan view of a privotal faucet spout with the device of the present invention attached thereto.

In FIGS. 1 and 2, will be observed that the knob portion 22 is configured to resemble a mushroom. In FIGS. 3 and 4, the knob portion 22 is configured to resemble a rose. Other configurations having aesthetic properties will of course be apparent to those skilled in the art.

In summary, the invention is seen to comprise a resilient, elastic ring portion 12 which is adapted to be slipped frictionally over a conventional spout portion 18 of a pivotal faucet spout assembly. The configuration of the device enables it to frictionally engage the spout. The configuration of an upwardly extending griping portion, which includes the reduced diameter portion 20 and the knob portion 22, provides a device in which the knob portion 22 will be at a lower temperature than the spout and will have substantially reduced thermal transfer properties. Accordingly, a person using the faucet, particularly when using same at high temperatures, will be able to easily grasp the knob portion 22 to move the faucet in any convenient position without experiencing pain or injury.

While there have been described above the principles of this invention in connection with specific apparatus, it is to be clearly understood that this description is made only by way of example and not as a limitation to the scope of the invention.

What is claimed is:

1. A thermally insulating knob accessory for use with a pivotal faucet spout comprising a deformable ring portion dimensioned to frictionally engage the outside surface of the distal portion of a pivotal faucet and a gripping portion fixedly secured to said ring portion and extending perpendicularly portion being made of a material having a low coefficent of thermal conductivity whereby a pivotal faucet spout can be manually manipulated when hot without the user burning the hands or fingers.

2. The accessory of claim 1 wherein said ring portion has a generally flat interior surface, said material having a high coefficient of friction.

3. The accessory of claim 2 wherein the circumferential dimension of said ring interior surface is less than the peripheral dimension of the exterior surface of a pivotal faucet.

4. The accessory of claim 3 wherein said gripping portion includes a knob portion and a connecting portion having a cross-sectional area less than the cross-sectional area of said knob portion.

5. The accessory of claim 4 wherein said ring portion of the knob accessory is molded.

6. The accessory of claim 5 wherein said knob portion is molded to produce an aestheticaly pleasing shape.

7. The accessory of claim 6 wherein said ring portion and said gripping portion are molded as an integral unit.

8. The accessory of claim 7 wherein said ring portion and said gripping portion are molded from rubber.

* * * * *